US007951046B1

(12) United States Patent
Barber, Jr.

(10) Patent No.: US 7,951,046 B1
(45) Date of Patent: May 31, 2011

(54) DEVICE, METHOD AND COMPUTER PROGRAM PRODUCT FOR TRACKING AND MONITORING AN EXERCISE REGIMEN

(76) Inventor: Ulysses Barber, Jr., New Port Richey, FL (US)

( * ) Notice: Subject to any disclaimer, the term of this patent is extended or adjusted under 35 U.S.C. 154(b) by 89 days.

(21) Appl. No.: 12/381,829

(22) Filed: Mar. 17, 2009

Related U.S. Application Data

(60) Provisional application No. 61/069,620, filed on Mar. 17, 2008.

(51) Int. Cl.
*A63B 15/02* (2006.01)
*A63B 71/00* (2006.01)
*G06F 3/00* (2006.01)

(52) U.S. Cl. ..... 482/9; 482/1; 482/8; 482/902; 715/961

(58) Field of Classification Search ..... 482/1, 8, 482/9, 902; 434/247; 715/961, 700, 704, 715/709, 716, 864
See application file for complete search history.

(56) References Cited

U.S. PATENT DOCUMENTS

| | | | | |
|---|---|---|---|---|
| 6,027,428 | A * | 2/2000 | Thomas et al. | 482/4 |
| 6,095,949 | A | 8/2000 | Arai | |
| 6,513,532 | B2 | 2/2003 | Mault | |
| 6,672,991 | B2 * | 1/2004 | O'Malley | 482/8 |
| 6,793,607 | B2 * | 9/2004 | Neil | 482/8 |
| 6,808,473 | B2 * | 10/2004 | Hisano et al. | 482/8 |
| 6,878,885 | B2 | 4/2005 | Miller-Kovach | |
| 6,913,559 | B2 * | 7/2005 | Smith | 482/4 |
| 6,971,972 | B1 * | 12/2005 | McGovern et al. | 482/3 |
| 7,056,265 | B1 * | 6/2006 | Shea | 482/8 |
| 7,128,693 | B2 * | 10/2006 | Brown et al. | 482/8 |
| 7,172,530 | B1 * | 2/2007 | Hercules | 482/4 |
| 7,670,263 | B2 * | 3/2010 | Ellis et al. | 482/8 |
| 7,693,584 | B2 * | 4/2010 | Pryor et al. | 700/17 |
| 7,717,825 | B2 * | 5/2010 | Van Der Hoeven | 482/8 |
| 7,736,272 | B2 * | 6/2010 | Martens | 482/8 |
| 2002/0142887 | A1 * | 10/2002 | O'Malley | 482/8 |
| 2005/0164833 | A1 * | 7/2005 | Florio | 482/9 |
| 2006/0025282 | A1 * | 2/2006 | Redmann | 482/8 |
| 2006/0252602 | A1 * | 11/2006 | Brown et al. | 482/9 |
| 2007/0033068 | A1 * | 2/2007 | Rao et al. | 705/2 |
| 2007/0033069 | A1 * | 2/2007 | Rao et al. | 705/2 |
| 2007/0042868 | A1 * | 2/2007 | Fisher et al. | 482/8 |
| 2007/0219058 | A1 * | 9/2007 | Fleishman | 482/8 |
| 2007/0225118 | A1 * | 9/2007 | Giorno | 482/1 |
| 2007/0260482 | A1 * | 11/2007 | Nurmela et al. | 705/2 |
| 2007/0271116 | A1 * | 11/2007 | Wysocki et al. | 705/2 |
| 2007/0275825 | A1 * | 11/2007 | O'Brien | 482/8 |
| 2007/0287596 | A1 * | 12/2007 | Case et al. | 482/8 |
| 2007/0293370 | A1 * | 12/2007 | Klingler | 482/4 |
| 2008/0076637 | A1 * | 3/2008 | Gilley et al. | 482/9 |
| 2008/0090703 | A1 * | 4/2008 | Rosenberg | 482/8 |
| 2008/0096726 | A1 * | 4/2008 | Riley et al. | 482/8 |
| 2008/0096727 | A1 * | 4/2008 | Lee et al. | 482/8 |

(Continued)

*Primary Examiner* — Loan Thanh
*Assistant Examiner* — Sundhara M Ganesan

(57) ABSTRACT

An exercise regimen tracking and monitoring device includes an electronic data recording device that allows users to manage their exercise regimens in a hands free manner. The device has a hand-held body provided with a display screen having graphical illustrating capabilities. An alpha numeric keypad is included for allowing a user to input and retrieve data. A clip is attached on the casing rear surface, facilitating attachment of the device to the user. A processor and a memory are included and is programmed to allow users to input and instantly recall a workout regimen. A timer is included to track and monitor progress reports on a daily, weekly or monthly basis. A playback device is also included to encourage users with motivational phrases.

8 Claims, 5 Drawing Sheets

U.S. PATENT DOCUMENTS

2008/0125289 A1* 5/2008 Pryor et al. ..... 482/8
2008/0200310 A1* 8/2008 Tagliabue ..... 482/8
2008/0220940 A1* 9/2008 Kasama ..... 482/8
2008/0254944 A1* 10/2008 Muri et al. ..... 482/8
2008/0258921 A1* 10/2008 Woo et al. ..... 340/573.1
2008/0300109 A1* 12/2008 Karkanias et al. ..... 482/8
2009/0048070 A1* 2/2009 Vincent et al. ..... 482/8
2009/0069156 A1* 3/2009 Kurunmaki et al. ..... 482/9
2009/0149299 A1* 6/2009 Tchao et al. ..... 482/9
2009/0326341 A1* 12/2009 Furlan ..... 600/301
2010/0045463 A1* 2/2010 Bradley et al. ..... 340/573.1
2010/0137106 A1* 6/2010 Oshima et al. ..... 482/8

* cited by examiner

DEVICE, METHOD AND COMPUTER PROGRAM PRODUCT FOR TRACKING AND MONITORING AN EXERCISE REGIMEN

CROSS REFERENCE TO RELATED APPLICATIONS

This application claims the benefit of U.S. Provisional Application No. 61/069,620, filed Mar. 17, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to monitoring devices and, more particularly, to a device, method and computer program product for tracking and monitoring an exercise regimen and thereby provide health enthusiasts and those seeking a healthier lifestyle with a convenient means of observing and adjusting their workout/exercise habits.

2. Prior Art

Management of diet, health, and fitness has drawn increasing amounts of attention as their importance has been recognized, and as consumers around the world have struggled to balance busy lives with fitness and proper diet. Despite the recognized importance of good health, consumers, on average, are becoming increasingly obese. This has resulted in a strong demand for devices and methods that assist individuals in setting and reaching dietary and fitness goals. Currently available devices and methods fail to meet the needs of average consumers.

There are serious problems with conventional weight loss programs. Weight change is related to the user's net caloric balance, the difference between caloric intake and caloric expenditure. However, determination of caloric intake and caloric expenditure are both problematic. Determining total energy expenditure is also difficult. The total energy expenditure of a person comprises a resting metabolic component and a physical activity component.

Accordingly, a need remains for an exercise regimen tracking and monitoring device in order to overcome the above-noted shortcomings. The present invention satisfies such a need by providing a device that is convenient and easy to use, is durable yet lightweight in design, is versatile in its applications, and eliminates the need to write down workout regimens or record fitness data on paper.

BRIEF SUMMARY OF THE INVENTION

In view of the foregoing background, it is therefore an object of the present invention to provide a device, method and computer program product for tracking and monitoring an exercise regimen over an extended period of time. These and other objects, features, and advantages of the invention are provided by a portable electronic device for tracking and monitoring a user-defined exercise regimen during extended time periods. Such a portable electronic device preferably includes a hand-held body including a display screen and a user interface communicatively coupled thereto.

The body further includes a processor communicatively coupled to the user interface. A memory is communicatively coupled to the processor. Such a memory preferably includes software instructions that cause the device to automatically track and monitor a series of user-selected exercise regimens during an associated time period respectively.

The body further includes a timer for keeping track of each the time period. An audio and video playback device electrically coupled to the processor. Such an audio and video playback device outputs a plurality of audio and video signals for encouraging the user to complete each of the exercise regimens within the time period associated therewith. A communication device may be connected to the processor as well as the audio and video playback device such that the user is able to send and receive data from a peripheral electronic device.

The present invention may further include a graphical user interface communicatively coupled to the processor and the display screen for graphically illustrating historical data associated with completion of the exercise regimens.

In one embodiment, the software instructions preferably include a control logic algorithm executing a series of chronological operating steps. Such chronological steps may include: prompting the user to define a first exercise parameter by choosing a first muscle group species; prompting the user to define a second exercise parameter by choosing a second muscle group species; if the first and second muscle groups species are associated with a common muscle group genus, then displaying a cumulative list of suggested exercise regimens; if the first and second muscle group species are not associated with the common muscle group genus, then displaying an abbreviated list of suggested exercise regimens; and prompting the user to select desired exercise regimens from the cumulative and abbreviated lists.

Each of the cumulative and abbreviated lists preferably includes a plurality of the exercise regimens, a plurality of the time periods associated with a unique one of each of the exercise regimens respectively, and a list of estimated calories that will be burned after completing each of the unique exercise regimens respectively.

The control logic algorithm may further include the chronological steps of: upon receiving the user selection, prompting the user to initiate a countdown of a first one of the associated time periods; prompting the user to begin a first one of the desired exercise regimens; and when the first time period lapses, instructing the audio and video playback device to emit an motivational audible message for encouraging the user to complete at least one more repetition of the desired exercise regimen.

The control logic algorithm may further include the chronological steps of: prompting the user to confirm completion of each the desired exercise regimens during a workout session; upon receiving the user confirmation, inquiring whether the user wants to log completed ones of the desired exercise regimens; and if the user answers yes, logging and saving to the memory the completed desired exercise regimens for later review.

The present invention may further include a method of utilizing a portable electronic device for tracking and monitoring a user-defined exercise regimen during extended time periods. Such a method preferably comprises the chronological steps of: providing a hand-held body, as described herein above. For example, the body may include a display screen and a user interface communicatively coupled thereto; a processor communicatively coupled to the user interface; a memory communicatively coupled to the processor. Such a memory includes software instructions for causing the device to automatically track and monitor a series of user-selected exercise regimens during an associated time period by executing the software instructions.

The body may further include a timer for keeping track of each the time period; an audio and video playback device electrically coupled to the processor; a communication device connected to processor as well as the audio and video playback device such that the user is able to send and receive data from a peripheral electronic device; and a graphical user interface communicatively coupled to the processor and the display screen.

The method may further include the chronological steps of: the audio and video playback device outputting a plurality of audio and video signals for encouraging the user to complete each of the exercise regimens within the time period associated therewith; and graphically illustrating historical data associated with completion of the exercise regimens.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
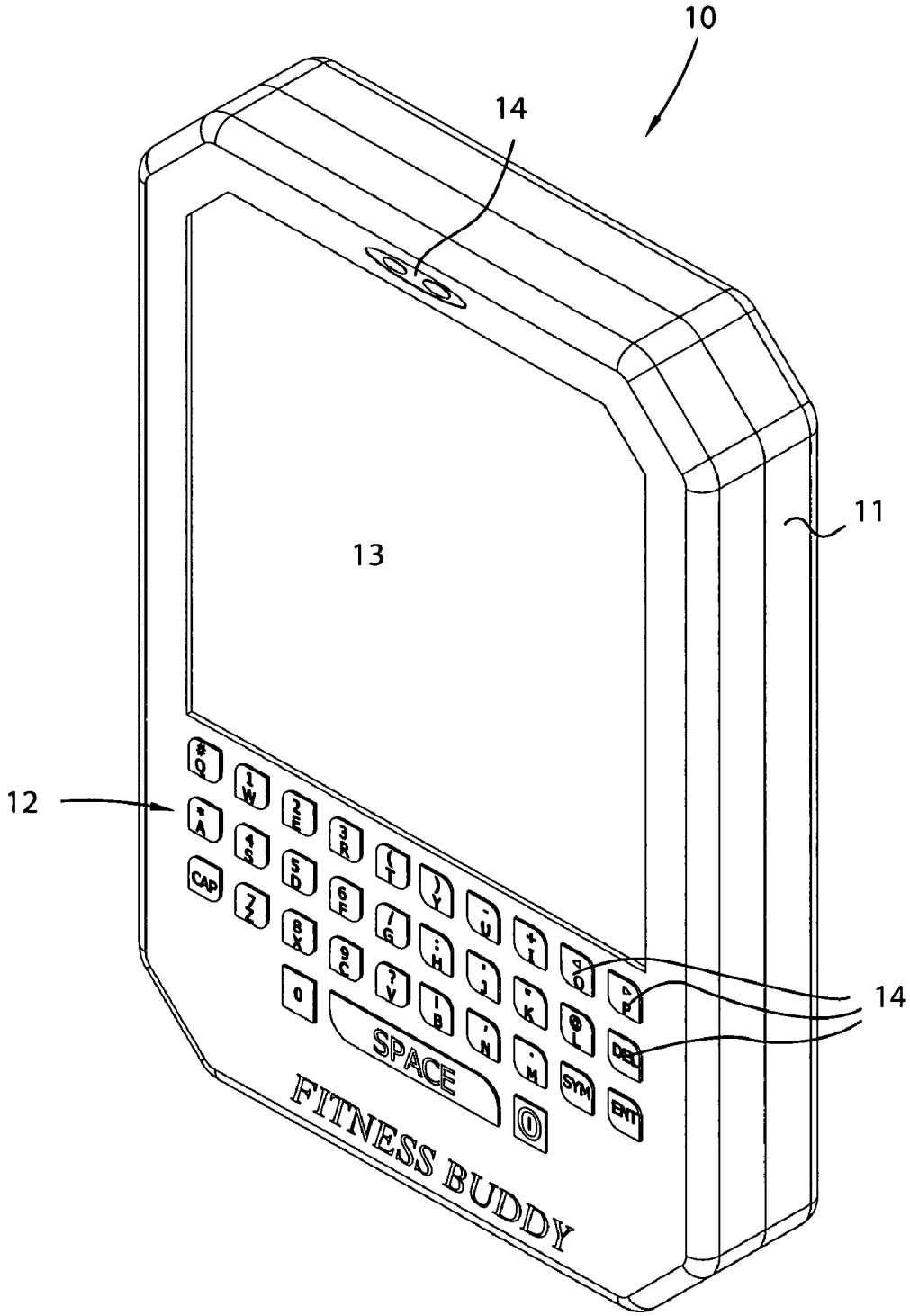
FIGS. 1-4 show various elevational views of an exemplary portable electronic device that is capable of performing the functions of the present invention.
Figure 2:
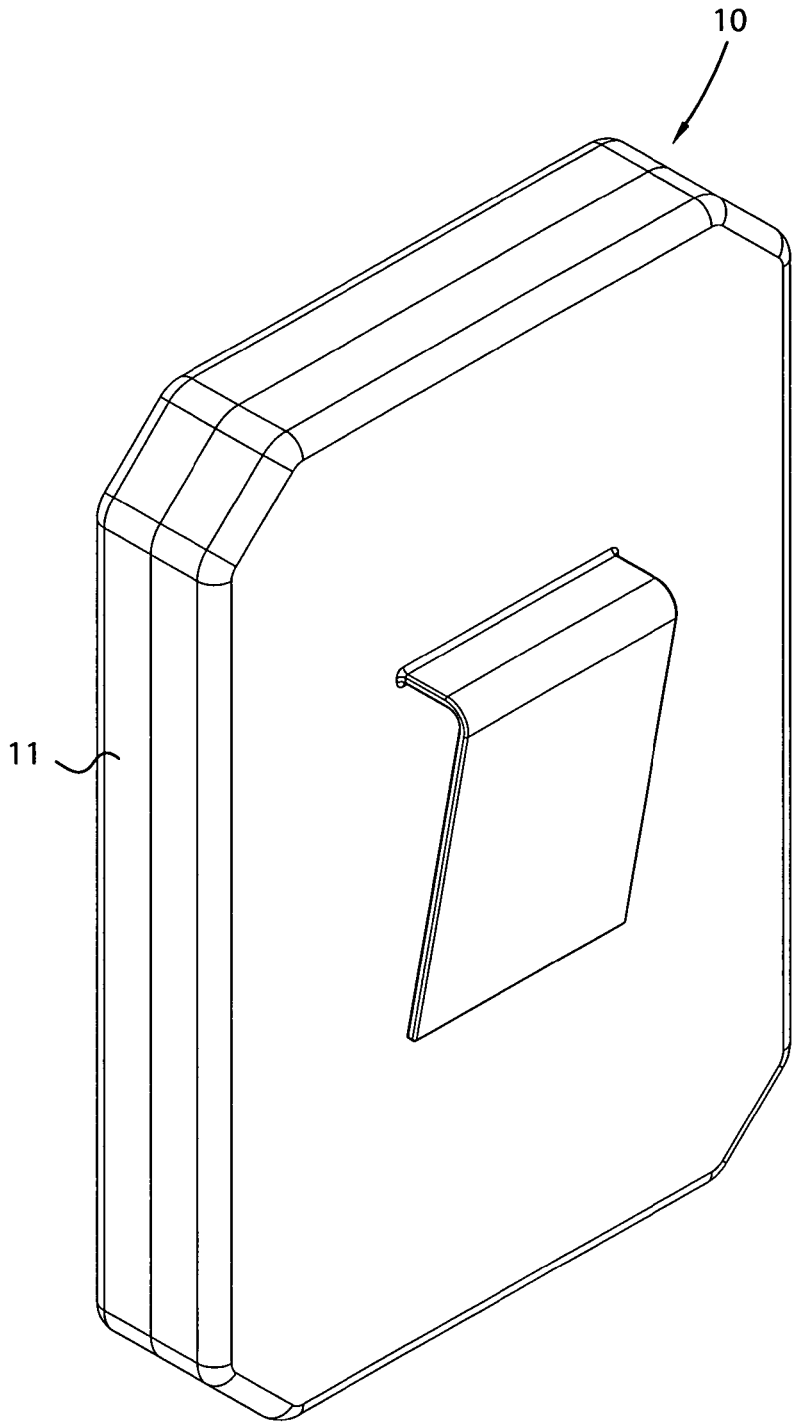
Figure 3:
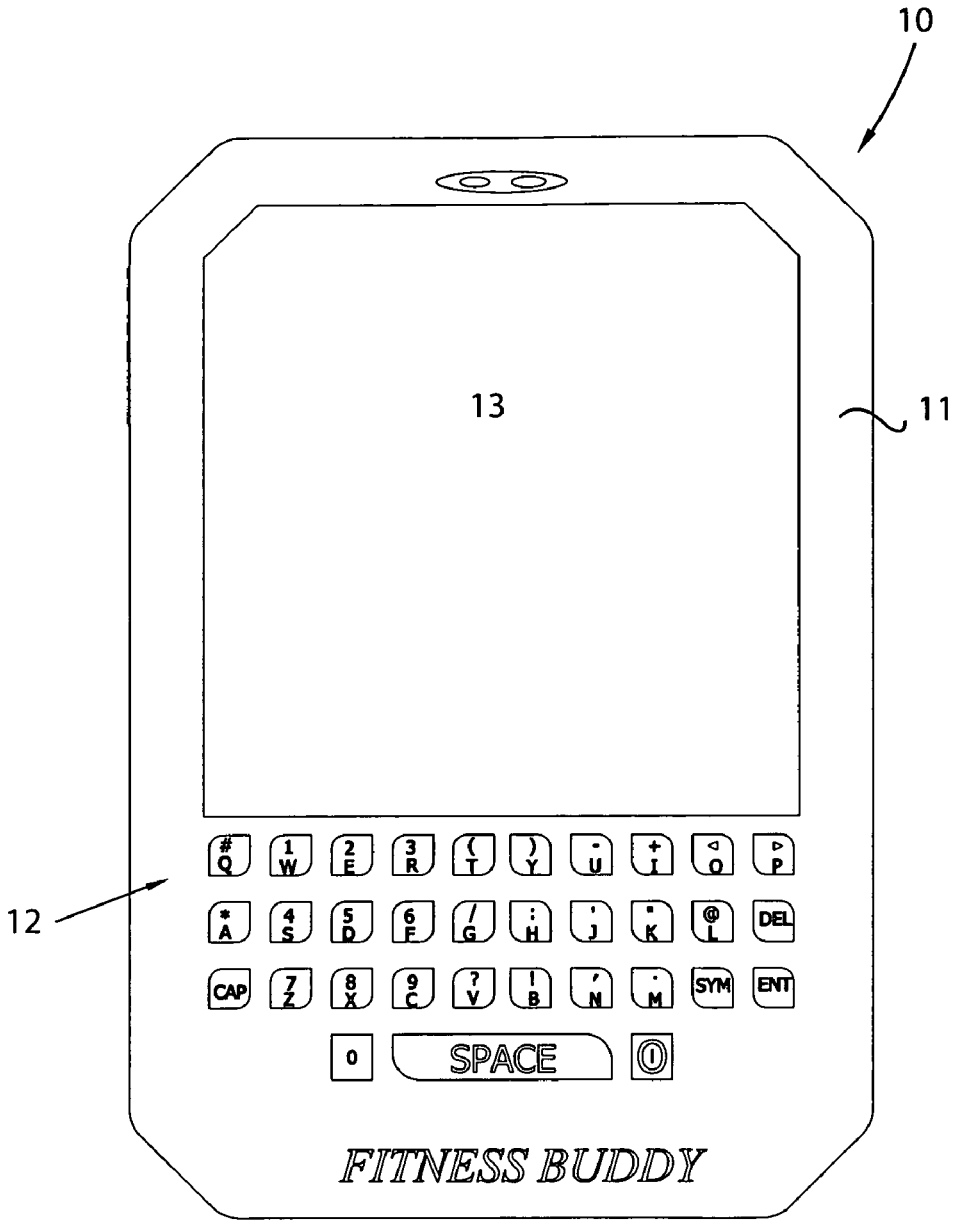
Figure 4:
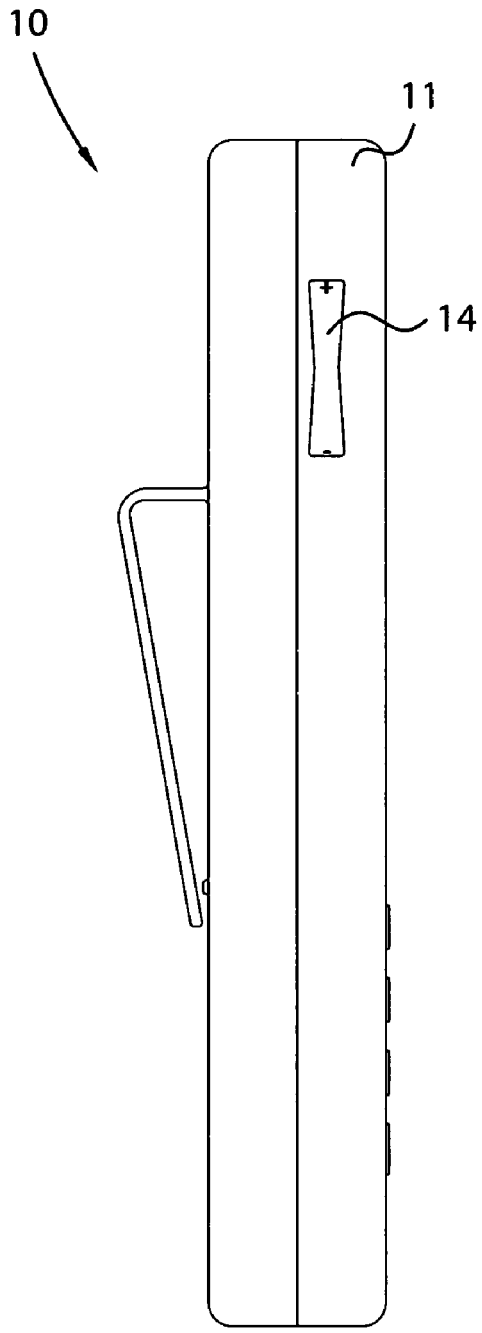
Figure 5:
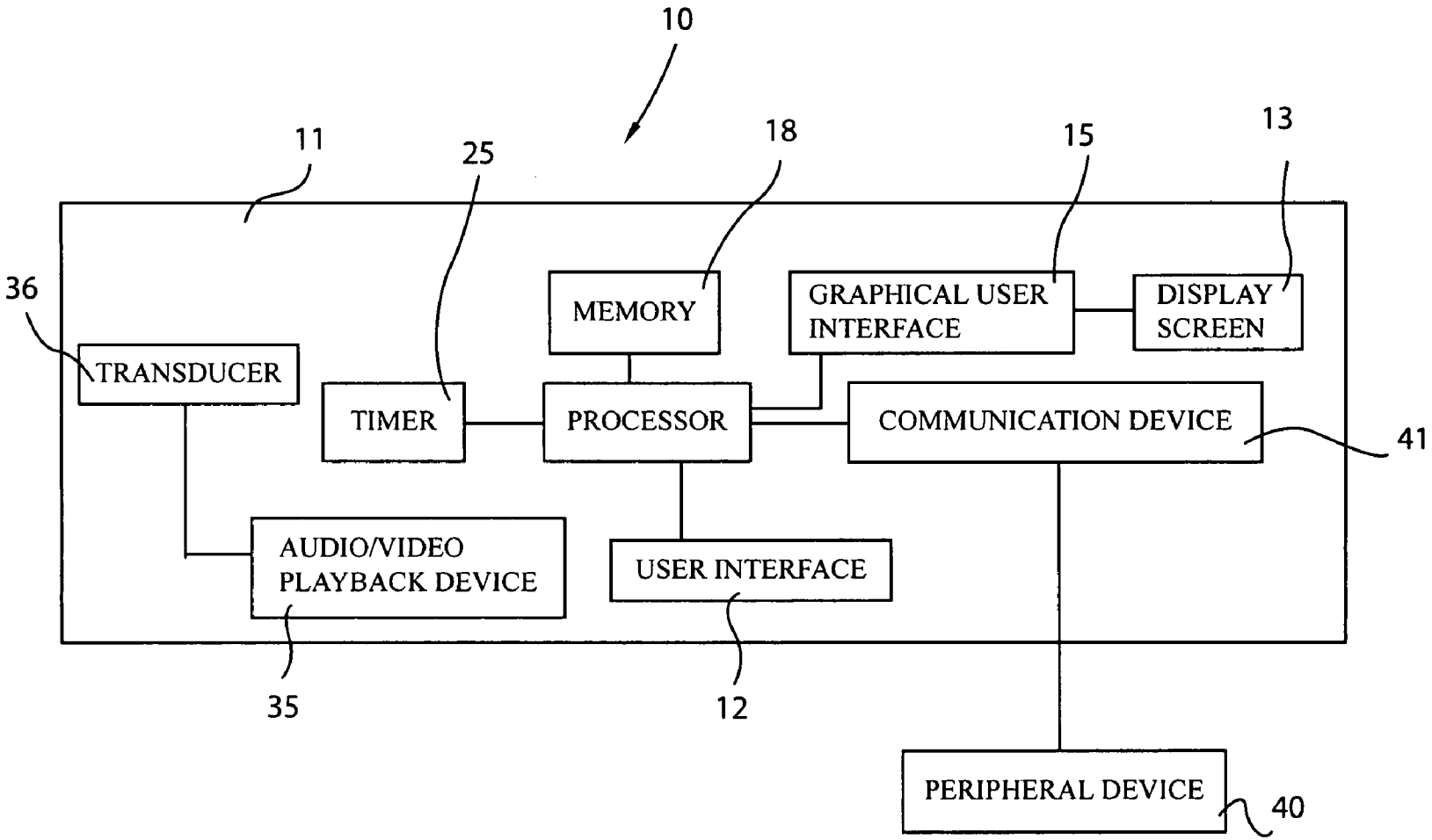
FIG. 5 is a high level schematic block diagram showing the interrelationship between the major electronic components of the present invention.

The device 10 of this invention is referred to generally in FIGS. 1-5 by the reference numeral 10 and is intended to provide a device 10, method and computer program product for tracking and monitoring an exercise regimen over an extended period of time. It should be understood that the present invention 10 may be used to input and instantly recall virtually any exercise regimen, which keeps track of many different types of exercise data.

One aspect of the present invention preferably includes an electronic data recording device 10 that advantageously allows users to manage their exercise regimens in a simple, hands free manner without worrying that they will lose or misplace the information.

Although the device 10 and method can be used to present an exercise routine in many different specialty disciplines, such as muscle building (weightlifting), muscle toning, and cardiovascular exercises, the present invention is especially suitable for presenting an exercise routine using commonly known body building exercises. Consequently, an exemplary embodiment of the present invention may be described using traditional well known weight lifting exercises in order to set forth the best embodiment contemplated.

The purpose of the device 10 is to track and monitor weight lifting exercise regimens over extended periods of time and thereby eliminates a need to carry a notepad and writing utensil during the exercise regimens. The device 10 provides an indication of: who is performing the exercises; when to perform the exercises; as well as a log of previously completed or non-completed exercises so that the user can easily track and monitor his/her progress during extended periods of time.

Thus, users can simply consult and retrieve all necessary information on a portable computer device 10, clipped conveniently to their person. In this manner, users can take better control of their workouts, which leads to overall improvement in their health. An innovative product, the present invention provides a welcome accessory for working out. Simple in design, yet effective in application, the device 10 is ideal for any individual, whether male or female.

In accordance with the present invention, a portable electronic device 10 for tracking and monitoring a user-defined exercise regimen during extended time periods preferably includes a hand-held body 11 including a display screen 13 and a user interface 12 communicatively coupled thereto.

The display screen 13 is configured for displaying various amounts of textual and/or graphical information. The display may be monochrome or color, of various physical dimensions, of various types. In one embodiment, the display may be suitable for displaying full motion video in color. By way of example and not limitation, the display may be comprised of a liquid crystal display (LCD); a field emission display FED; so called "E-ink" technologies, which employ microspheres having at least two reflectance states; a cathode-ray tube (CRT) display; a gas plasma display; an LED readout configured to display alpha-numeric and graphical information; or any other compatible visual display device. In a preferred implementation, the display is large enough to display, with clarity, one or more lines of information. Optionally, the display screen 13 may be configured with a touch-screen interface, to present a user with a graphical user interface.

The user interface 12 may include a variety of stand-alone or shared devices that are capable of generating and transmitting a control signal upon receiving a user input. For example, exemplary user interface devices may include a remote controller employing RF, infra-red, acoustic or cellular technology, as well known in the industry.

In alternate embodiments, the user interface 12 may include a cell phone, a keyboard, a mouse, etc. that may be comprised of commercially available hardware and software operating systems, for example. The aforementioned user interfaces are intended to represent a broad category of exemplary user interfaces capable of functioning in accordance with the present invention. Of course, the user interfaces may include other components, peripherals and software applications provided they are compatible and capable of cooperating with remaining devices of the present invention. In addition, the user interfaces may include information, documents, data and files needed to provide functionality and enable performance of methodologies in accordance with an exemplary embodiment of the invention.

Referring to FIGS. 1-5 in general, the device 10 may be a hand-held device 10 that is sized to readily fit into a person's pocket, similar to a PDA (personal digital assistant) or palmtop computer. The body 11 of the device 10 can be manufactured into most any shape, such as a rectangular PDA.

The user interface 12 may include a series of control buttons 14. For example, to the bottom side of the screen 13 is a keyboard having alphanumeric buttons 14. A power button may be positioned above the screen 13. Other conventional buttons such as directional arrows may also be provided.

The body 11 further includes a processor 17 communicatively coupled to the user interface 12. The processor 17 may include a microprocessor or other devices capable of being programmed or configured to perform computations and instruction processing in accordance with the invention. Such other devices may include microcontrollers, digital signal processors (DSP), Complex Programmable Logic Device (CPLD), Field Programmable Gate Arrays (FPGA), application-specific integrated circuits (ASIC), discrete gate logic, and/or other integrated circuits, hardware or firmware in lieu of or in addition to a microprocessor.

Functions and process steps described herein may be performed using programmed computer devices and related hardware, peripherals, equipment and networks. When programmed, the computing devices are configured to perform functions and carry out steps in accordance with principles of the invention. Such programming may comprise operating systems, software applications, software modules, scripts, files, data, digital signal processors (DSP), application-specific integrated circuit (ASIC), discrete gate logic, or other hardware, firmware, or any conventional programmable software, collectively referred to herein as a module.

A memory 18 is communicatively coupled to the processor 17. Such a memory 18 preferably includes software instructions that cause the device 10 to automatically track and monitor a series of user-selected exercise regimens during an associated time period respectively. The memory 18 includes programmable software instructions that are executed by the processor 17.

In particular, the programmable software instructions include a plurality of chronological operating steps that define a control logic algorithm for performing the intended functions of the present invention. Such software instructions may be written in a variety of computer program languages such as C++, Fortran and Pascal, for example. One skilled in the art understands that such software instructions may contain various Boolean logic processes that perform the intended function of the present invention. Therefore, the specific source or object code of the software program is not intended to be a limiting factor in executing the present invention's intended function.

The memory 18, which enables storage of data and programs, may include RAM, ROM, flash memory and any other form of readable and writable storage medium known in the art or hereafter developed. The memory 18 may be a separate component or an integral part of another component such as processor 17.

The body 11 further includes a timer 25 for keeping track of each time period. An audio and video playback device 35 is electrically coupled to the processor 17. Such an audio and video playback device 35 outputs a plurality of audio and video signals for encouraging the user to complete each of the exercise regimens within the time period associated therewith. The timer 25 may be adjustable set for one to sixty minutes, as needed by the user.

In one embodiment, the audio/video playback device 35 is operably coupled to the communication device 41 for permitting the user to download and playback audio/video files from the device 40. Such a playback device 35 may include a transducer 36 (speaker) that emits motivational audible messages. For example, one optional aspect of the operational program is the ability to provide audible signals and commands to motivate the completion of the exercise regimens. Such motivational phrases may include, "Stay Focused," "Be Strong," "Stay Positive," or "Be Powerful!", for example.

A communication device 41 may be connected to the processor 17 as well as the audio and video playback device 35 such that the user is able to send and receive data from a peripheral electronic device 40. Another optional aspect of the operational program is to provide a fitness report that can be transmitted the peripheral electronic device 40 for later retrieval or printing. Accordingly, the user is able to easily record and track progress reports on a daily, weekly or monthly basis.

The present invention may further include a graphical user interface 15 communicatively coupled to the processor 17 and the display screen 13 for graphically illustrating historical data associated with completion of the exercise regimens. The graphical user interface 15 enables the device 10 to present visual graphical messages and historical data regarding the performance of the exercise regimen. In one embodiment, a touch screen interface is also provided to communicate user inputs directly to the user interface 12 via a stylus, for example.

In one embodiment, the software instructions preferably include a control logic algorithm executing a series of chronological operating steps. Such chronological steps may include: prompting the user to define a first exercise parameter by choosing a first muscle group species (biceps, triceps, quadriceps, etc); prompting the user to define a second exercise parameter by choosing a second muscle group species (back, shoulders, chest, etc.); if the first and second muscle groups species are associated with a common muscle group genus (upper thoracic region, lower abdominal region, leg region, etc.), then displaying a cumulative list of suggested exercise regimens (chest/triceps, back/biceps, shoulders/abdomen); if the first and second muscle group species are not associated with the common muscle group genus, then displaying an abbreviated list of suggested exercise regimens (chest, biceps, abdomen); and prompting the user to select desired exercise regimens from the cumulative and abbreviated lists. Each of the cumulative and abbreviated lists preferably includes a plurality of the exercise regimens (bench press, arm curls, pull-ups, etc.), a plurality of the time periods associated with a unique one of each of the exercise regimens respectively (30 minutes, 20 minutes, 5 minutes, etc.), and a list of estimated calories that will be burned after completing each of the unique exercise regimens (50, 75, 100, etc), respectively.

By utilizing the present invention, a person is initially prompted to begin an exercise regimen. The exercise regimens are spread out over the course of the day in short periods of time that typically last less than five minutes. As a result, the present invention motivates people to exercise at work, while commuting, and while at home without requiring a large commitment of time. The device 10 can also motivate people to control their caloric intake or balance their caloric intake with exercise. In this manner, people can better monitor and control their muscle mass and weight.

The operation of the present invention is software driven. As such, the manner and images used to select and display the various exercise regimens are as boundless as the imagination of the programmer. Regardless of how the program is written, the software program contains the following key features. The software program presents a variety of different types of exercise regimens that are appropriate for different user-defined parameters (muscle genus, time period, etc.). Such user-defined parameters may be entered via the keyboard or touch screen interface.

Therefore, the exercise regimens may be customized, as desired by the user wherein some of the exercise modes contain exercises that are hard and some of the exercise modes contain exercises that are easy. The software program should maintain a log of the exercise regimens and as well as monitor progress over extended time periods. Such a progress can be graphically illustrated on the display screen 13 via the graphical user interface 15. A time frame is also selected in which the exercise regimens should be performed.

The control logic algorithm may further include the chronological steps of: upon receiving the user selection, prompting the user to initiate a countdown of a first one of the associated time periods; prompting the user to begin a first one of the desired exercise regimens; and when the first time period lapses, instructing the audio and video playback device 35 to emit a motivational audible message for encouraging the user to complete at least one additional repetition of the current exercise regimen.

The control logic algorithm may further include the chronological steps of: prompting the user to confirm completion of each the desired exercise regimens during a workout session; upon receiving the user confirmation, inquiring whether the user wants to log completed ones of the desired exercise regimens; and if the user answers yes, logging and saving to the memory 18 the completed desired exercise regimens for later review.

After having completed various exercise modes in a particular day, the device 10 can calculate how many calories have been burned. Using the touch screen interface, a user can access a display menu that contains a heading for predetermined exercise regimens such as weight lifting and cardiovascular exercises, for example. Alternately, the user can create customized exercise regimens by identifying the muscle group or goal of the exercise regimen. For example, the user may desire to build muscle mass in his/her biceps. By making such a selection, a list of suggested exercise regimens is displayed. The user can then select, which (if any) exercise regimens to track and monitor over an extended time period.

In one embodiment, the device 10 can display the total calories burned by the executed exercise regimens each day. Such data is also charted by the graphical user interface 15 for providing easily understood information. This information can be also displayed as part of the progress report.

The present invention may further include a method of utilizing a portable electronic device 10 for tracking and monitoring a user-defined exercise regimen during extended time periods. Such a method preferably comprises the chronological steps of: providing a hand-held body 11, as described hereinabove. For example, the body 11 may include a display screen 13 and a user interface 12 communicatively coupled thereto; a processor 17 communicatively coupled to the user interface 12; a memory 18 communicatively coupled to the processor 17. Such a memory 18 includes software instructions that cause the device 10 to automatically track and monitor a series of user-selected exercise regimens during an associated time period by executing the software instructions.

The body 11 may further include a timer 25 for keeping track of each time period; an audio and video playback device 35 electrically coupled to the processor 17; a communication device 41 connected to processor 17 as well as the audio and video playback device 35 such that the user is able to send and receive data from a peripheral electronic device 40; and a graphical user interface 15 communicatively coupled to the processor 17 and the display screen 13.

The method may further include the chronological steps of: the audio and video playback device 35 outputting a plurality of audio and video signals for encouraging the user to complete each of the exercise regimens within the time period associated therewith; and graphically illustrating historical data associated with completion of the exercise regimens.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable electronic device for tracking and monitoring a user-defined exercise regimen during extended time periods, said portable electronic device comprising: a hand-held body comprising a display screen and a user interface communicatively coupled thereto;

a processor communicatively coupled to said user interface;

a memory communicatively coupled to said processor, said memory including software instructions that cause said device to automatically track and monitor a series of user-selected exercise regimens during an associated time period respectively;

a timer for keeping track of each said time period;

an audio and video playback device electrically coupled to said processor, said audio and video playback device outputting a plurality of audio and video signals for encouraging the user to complete each of said exercise regimens within said time period associated therewith;

a communication device connected to processor as well as said audio and video playback device such that the user is able to send and receive data from a peripheral electronic device;

wherein said software instructions comprise: a control logic algorithm executing a series of chronological operating steps comprising:

prompting the user to define a first exercise parameter by choosing a first muscle group species;

prompting the user to define a second exercise parameter by choosing a second muscle group species;

if said first and second muscle groups species are associated with a common muscle group genus, then displaying a cumulative list of suggested exercise regimens;

if said first and second muscle group species are not associated with said common muscle group genus, then displaying an abbreviated list of suggested exercise regimens; and prompting the user to select desired exercise regimens from said cumulative and abbreviated lists.

2. The portable electronic device of claim 1, wherein each of said cumulative and abbreviated lists comprises:

a plurality of said exercise regimens;

a plurality of said time periods associated with a unique one of each of said exercise regimens respectively; and a list of estimated calories that will be burned after completing each of said unique exercise regimens respectively.

3. The portable electronic device of claim 2, wherein said control logic algorithm further comprises the chronological steps of:

upon receiving the user selection, prompting the user to initiate a countdown of a first one of said associated time periods;

prompting the user to begin a first one of said desired exercise regimens; and when said first time period lapses, instructing said audio and video playback device to emit an motivational audible message for encouraging the user to complete at least one more repetition of said desired exercise regimen.

4. The portable electronic device of claim 3, wherein said control logic algorithm further comprises the chronological steps of:

prompting the user to confirm completion of each said desired exercise regimens during a workout session;

upon receiving said user confirmation, inquiring whether the user wants to log completed ones of said desired exercise regimens; and if the user answers yes, logging and saving to said memory said completed desired exercise regimens for later review.

5. A portable electronic device for tracking and monitoring a user-defined exercise regimen during extended time periods, said portable electronic device comprising: a hand-held body comprising a display screen and a user interface communicatively coupled thereto;

a processor communicatively coupled to said user interface;

a memory communicatively coupled to said processor, said memory including software instructions that cause said device to automatically track and monitor a series of user-selected exercise regimens during an associated time period respectively;

a timer for keeping track of each said time period;

an audio and video playback device electrically coupled to said processor, said audio and video playback device outputting a plurality of audio and video signals for encouraging the user to complete each of said exercise regimens within said time period associated therewith;

a communication device connected to processor as well as said audio and video playback device such that the user is able to send and receive data from a peripheral electronic device;

a graphical user interface communicatively coupled to said processor and said display screen for graphically illustrating historical data associated with completion of said exercise regimens;

wherein said software instructions comprise: a control logic algorithm executing a series of chronological operating steps comprising:

prompting the user to define a first exercise parameter by choosing a first muscle croup species;

prompting the user to define a second exercise parameter by choosing a second muscle group species;

if said first and second muscle groups species are associated with a common muscle group genus, then displaying a cumulative list of suggested exercise regimens;

if said first and second muscle group species are not associated with said common muscle group genus, then displaying an abbreviated list of suggested exercise regimens; and prompting the user to select desired exercise regimens from said cumulative and abbreviated lists.

6. The portable electronic device of claim 5, wherein each of said cumulative and abbreviated lists comprises:

a plurality of said exercise regimens;

a plurality of said time periods associated with a unique one of each of said exercise regimens respectively; and a list of estimated calories that will be burned after completing each of said unique exercise regimens respectively.

7. The portable electronic device of claim 6, wherein said control logic algorithm further comprises the chronological steps of:

upon receiving the user selection, prompting the user to initiate a countdown of a first one of said associated time periods;

prompting the user to begin a first one of said desired exercise regimens; and when said first time period lapses, instructing said audio and video playback device to emit an motivational audible message for encouraging the user to complete at least one more repetition of said desired exercise regimen.

8. The portable electronic device of claim 7, wherein said control logic algorithm further comprises the chronological steps of:

prompting the user to confirm completion of each said desired exercise regimens during a workout session;

upon receiving said user confirmation, inquiring whether the user wants to log completed ones of said desired exercise regimens; and if the user answers yes, logging and saving to said memory said completed desired exercise regimens for later review.

* * * * *